United States Patent [19]

Morse

[11] Patent Number: 4,802,514

[45] Date of Patent: Feb. 7, 1989

[54] OVERFLOW SPILLAGE PREVENTER FOR FUEL TANKS IN BOATS

[76] Inventor: Chris L. Morse, 6 Coach Rd., Savannah, Ga. 31419

[21] Appl. No.: 32,477

[22] Filed: Mar. 31, 1987

[51] Int. Cl.[4] ..... B65B 3/04

[52] U.S. Cl. ..... 141/86; 141/311 A; 141/390; 114/343; 248/206.3; 137/312

[58] Field of Search ..... 248/205.5, 205.6, 205.7, 248/205.8, 205.9, 200.1, 206.1, 206.2, 206.3, 206.4, 363; 362/397; 141/86, 87, 88, 119, 390, 97, 311 A, 346, 369–392; 222/108; 137/312; 114/343, 270

[56] References Cited

U.S. PATENT DOCUMENTS 2,538,813 1/1951 Wagner ..... 141/97

2,555,868 6/1951 Bowman ..... 141/86

3,003,666 10/1961 Stone ..... 141/86 X 4,082,125 4/1978 Wilson et al. ..... 141/86

*Primary Examiner*—Henry J. Recla

*Assistant Examiner*—Ernest G. Cusick

*Attorney, Agent, or Firm*—Cushman, Darby & Cushman

[57] ABSTRACT

A fuel spillage prevention receptacle for use on boats that can be mounted on the hull of a boat by one or more suction cup members beneath the outlet of a fuel tank air vent so that fuel expelled through the vent is collected in the receptacle; a flexible upper lip is provided on the receptacle so as to tightly seal the apparatus against the hull of the boat; and a pivotable baffle member is provided to direct fuel that is expelled from the air vent at a high velocity downwardly into the receptacle.

2 Claims, 2 Drawing Sheets

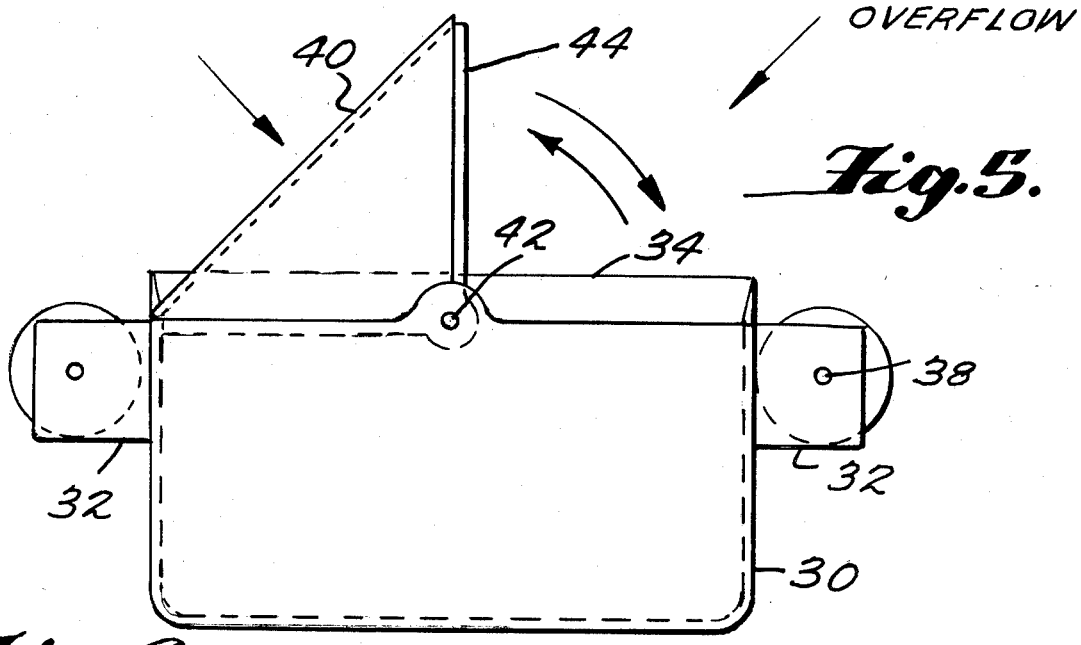
Fig. 5.
Fig. 6.
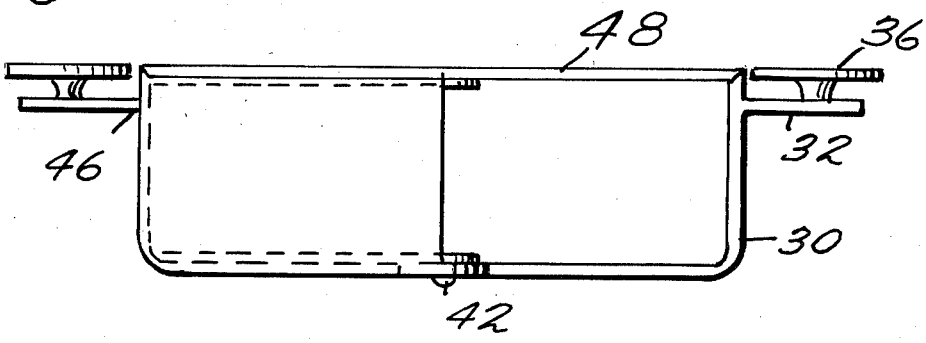
Fig. 7.
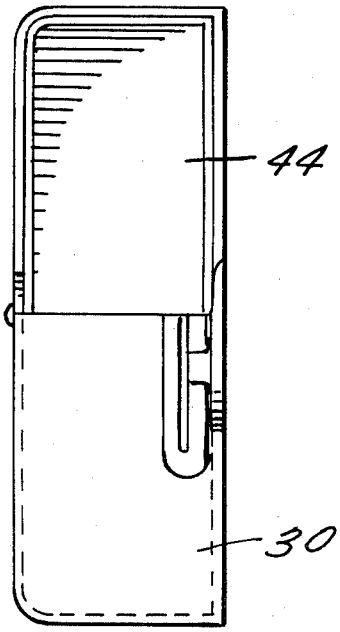

OVERFLOW SPILLAGE PREVENTER FOR FUEL TANKS IN BOATS

BACKGROUND OF THE INVENTION

1. Field of the Invention

The present invention relates to a receptacle for collecting and retaining liquid fuel overflow from an air vent in a fuel tank of a boat while the fuel tank is being filled, thereby preventing water pollution.

2. Description of the Prior Art

Air vents are commonly provided in the fuel tanks of boats in order to permit air that is being displaced while the tank is being filled to escape. Such vents usually open out into a downwardly pointed outlet in the hull of the ship, so that vapor loss is minimized during normal use of the boat, and so that water cannot collect in the air vent passage.

A problem in the prior art was that fuel during refilling flowed out of the tank through the air vent and down the side of the boat, thereby polluting the water and wasting fuel. This resulted in a worsening of the already severe water pollution problem that exists in many lakes and marinas.

At least one one attempt has been made in the past to solve the above mentioned problem. This attempt is described in U.S. Pat. No. 4,082,125, which discloses a spillage collection device for fuel tanks in boats. However, a problem existed in the device in that it was not compatible with many of the marine fuel tank vents which are in use today. In the disclosed embodiment, a receptacle is attached directly to the rim of an air vent by means of a locking strap having a pair of spaced locking slots therein which engage the rim. Consequently, the receptacle cannot be attached to an air vent having a rim of a different diameter than the air vent it was made to be attached to.

A further deficiency of such prior art devices was that they were unable to collect droplets of fuel that are expelled from the nozzle at a relatively high velocity, a phenomenon commonly known as blow-by. Blow-by is caused by the turbulence created in the tank while it is being filled, and may result in a measurable volume of fuel being ejected through the air vent outlet as the air is being pushed out of the tank.

A further disadvantage of a prior art device of this type is that it tends to scrape the side of the boat while being placed over the rim of the air vent nozzle, since it must be slid between the rim of the nozzle and the hull of the boat.

It is clear, therefore, that there exists a long and unfilled need in the prior art for an apparatus that is mountable on the hull of a boat for collecting fuel leakage from fuel tank air vents that is universally mountable on all boats, does not mar the hull of a boat and is effective in intercepting blow-by.

SUMMARY OF THE INVENTION

A first object of the present invention is to provide a receptacle for preventing the accidental discharge of liquid fuel from an air vent of an enclosed fuel storage tank in a boat into the surrounding water.

A further object of the present invention is to provide a fuel spillage collection device that is universally mountable to the hull of any boat.

An additional object of the present invention is to provide a fuel spillage prevention device that is mountable to the hull of a boat that cannot scratch the hull of the boat while it is being mounted.

An additional object of the present invention is to provide an improved fuel spillage prevention device whereby blow-by is intercepted by means of a pivotable baffle member and is guided thereby into a receptacle.

To achieve the foregoing objectives, the invention in its preferred embodiment includes one or more suction cup members that are attached to a hollow receptacle for mounting the receptacle to a hull of a boat beneath a fuel tank air vent. A flexible upper lip portion is preferably provided to guide droplets of fuel from the hull of the boat into the receptacle. In a second embodiment, a pivotable baffle is provided to guide speed aerated fuel that is emitted at high speed from the air vent into the receptacle.

Other objects, features, and characteristics of the present invention, as well as the methods and operation and functions of the related elements of the structure, and the combination of parts and economies of manufacture, will become apparent upon consideration of the following description and the appended claims with reference to the accompanying drawings, all of which form a part of this specification, wherein like reference numerals designate corresponding parts in the various figures.

BRIEF DESCRIPTION OF THE DRAWINGS

FIG. 5 is a front elevational view of a second embodiment of the present invention.

FIG. 6 is a top elevational view of the embodiment shown in FIG. 5.

FIG. 7 is a side elevational view of the embodiment shown in FIG. 5.

DESCRIPTION OF THE PREFERRED EMBODIMENT

Figure 1:
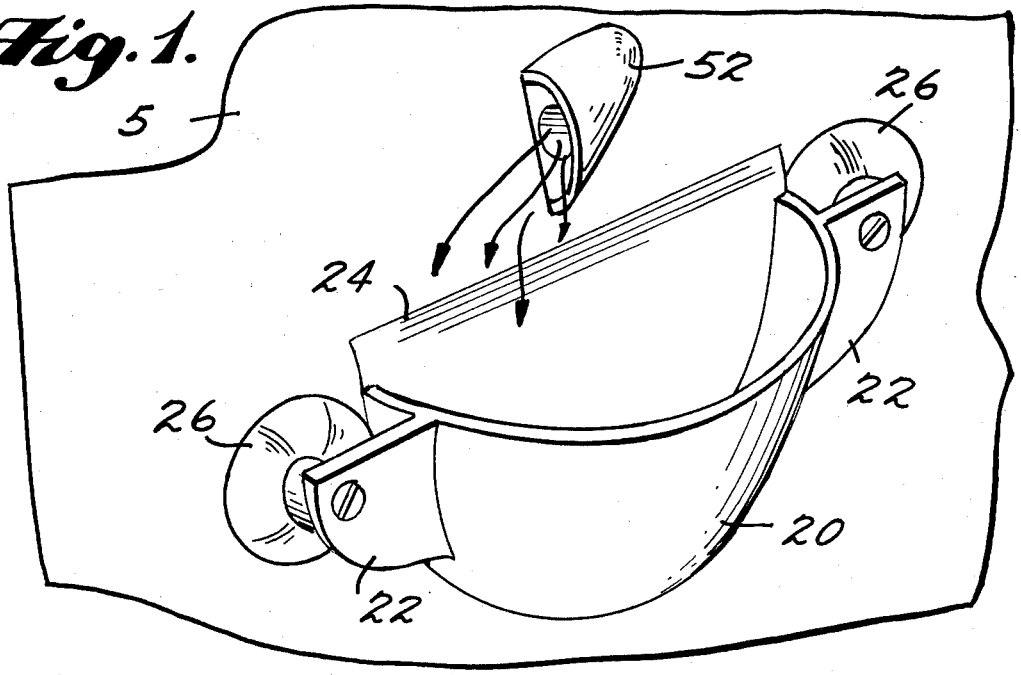
FIG. 1 is a view in perspective, showing a first embodiment of the present invention in conjunction with the fuel overflow receptacle and the hull of a boat.
Figure 2:
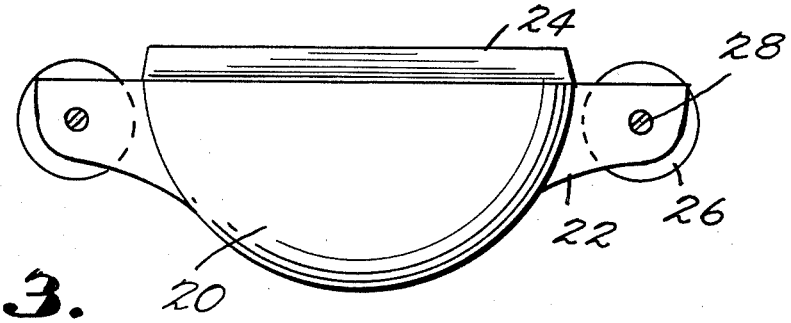
FIG. 2 is a front elevational view of the first embodiment shown in FIG. 1.
Figure 3:
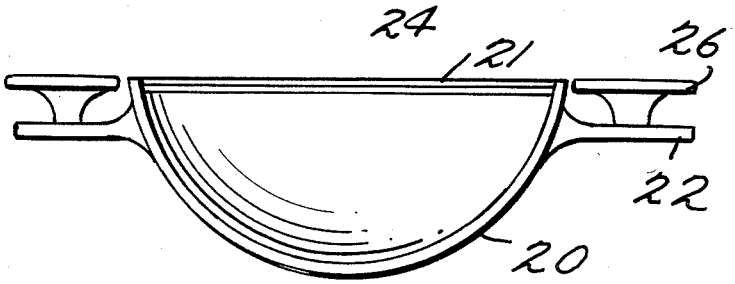
FIG. 3 is a top elevational view of the embodiment shown in FIG. 1.
Figure 4:
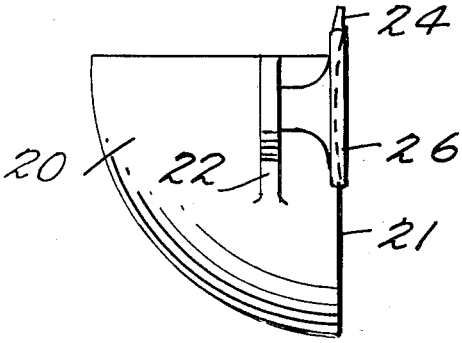
FIG. 4 is a side elevational view of the embodiment shown in FIG. 1.

Referring to FIG. 1, reference numeral 52 refers to a fuel tank air vent which is provided on the hull 50 of a boat. As shown in FIG. 1, a receptacle 20 is mounted on the hull 50 of the boat by means of a pair of suction cups 26, each of which are attached to a projection 22 of the receptacle by means of a fastening member 28. Of course, more than one suction cup could be provided on each of the projections. As shown in FIG. 4, the receptacle 20 has a flat rear wall 21 that is adapted to rest against a flat surface on the hull 50.

In order to prevent fuel from dripping between the flat rear wall 21 and the hull, a flexible upper lip 24 is provided on the receptacle to fit tightly against the hull. As shown in FIG. 4, both the suction cups 26 and the flexible upper lip 24 protrude outwardly to some degree beyond the plane defined by the flat rear wall 21 of the receptacle. In this way, a vacuum may be developed between the suction cup and the hull of the boat when the assembly is pressed against the hull. At the same time, the flexible upper lip 24 is pushed back so as to be made flush with the flat rear wall 21 of the receptacle, thereby ensuring a tight seal against the hull. Accordingly, when the assembly is properly mounted against the hull of the boat, the suction cups 26, the flexible upper lip 24 and the flat rear wall 21 of the receptacle will be disposed substantially in the same plane.

A second embodiment of the present invention is illustrated in FIGS. 5–7. In this embodiment, a receptacle 30 has a pair of projections 32 which are joined to the receptacle by means of a fillet 46. Suction cups 36 are mounted to each of the projections 32 by means of fastening members 38. A flexible upper lip 34 is also provided on the receptacle, and as in the first embodiment, both the suction cups and the flexible upper lip protrude inwardly past the plane defined by the flat rear surface 48 of the receptacle so as to facilitate attachment of the suction cups to the hull of the boat, and to effect a tight seal between the flexible upper lip and the hull.

A distinguishing feature of the second embodiment of the present invention is the provision of a pivotable baffle member 40 that is mounted on the upper portion of the receptacle body 30 by means of a pivot hinge 42. The purpose of the baffle is as follows. When a high velocity mixture of air and fuel is emitted from the vent, fuel droplets that could not be collected in prior art devices are intercepted by a surface 44 on the baffle 40 and directed downwardly into the receptacle 30 where they are collected. The baffle is made pivotable so that it can be used on either side of the boat. Thus, the fuel spillage prevention device according to the second embodiment of the present invention has utility on all types of boats, and the same device may be used on either side of the boat.

While the invention has been described in connection with what is presently considered to be the most practical and preferred embodiment, it is to be understood that the invention is not limited to the disclosed embodiment, but, on the contrary, is intended to cover various modifications and equivalent arrangements included within the spirit and scope of the appended claims.

What I claim is:

1. A fuel spillage prevention device for mounting to the hull of a boat beneath a fuel tank air vent outlet, comprising:

receptacle means for collecting and storing fuel that is expelled from said outlet, said receptacle means having a flat rear wall that is adapted to contact said hull, and one or more outwardly extending projections; and suction cup means attached to each of said projections for securing said receptacle means to said hull, said suction cup means protruding beyond said flat rear wall of said receptacle means when the apparatus is not attached to the hull of a boat whereby said receptacle may be firmly attached to the hull of a boat without damaging the hull, said device further including baffle means for intercepting fuel that is expelled from said outlet at high speeds, and means for pivotally mounting said baffle means relative to said receptacle means, whereby said baffle means may be positioned to intercept the fuel expelled from outlets on either side of a boat.

2. Apparatus according to claim 1, further comprising flexible upper lip means attached to an upper portion of said flat rear wall of said receptacle means for tightly sealing said receptacle means against said hull whereby fuel from said outlet is prevented from running between said receptacle means and said hull.

* * * * *